US007466078B2

(12) United States Patent
Kim et al.

(10) Patent No.: US 7,466,078 B2
(45) Date of Patent: Dec. 16, 2008

(54) PLASMA DISPLAY PANEL

(75) Inventors: Yong-Jun Kim, Suwon-si (KR); Tae-Kyoung Kang, Suwon-si (KR); Ki-Jung Kim, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 421 days.

(21) Appl. No.: 11/208,784

(22) Filed: Aug. 23, 2005

(65) Prior Publication Data

US 2006/0043894 A1 Mar. 2, 2006

(30) Foreign Application Priority Data

Aug. 30, 2004 (KR) ..... 10-2004-0068473

(51) Int. Cl.
*H01J 17/49* (2006.01)

(52) U.S. Cl. ..... 313/586; 313/584; 313/585; 313/587

(58) Field of Classification Search ..... 313/582–587; 315/169.1, 169.3; 445/23–25; 345/60
See application file for complete search history.

(56) References Cited

U.S. PATENT DOCUMENTS 5,541,618 A 7/1996 Shinoda
5,661,500 A 8/1997 Shinoda et al.
5,663,741 A 9/1997 Kanazawa
5,674,553 A 10/1997 Shinoda et al.
5,724,054 A 3/1998 Shinoda
5,786,794 A 7/1998 Kishi et al.

(Continued)

FOREIGN PATENT DOCUMENTS

JP 10-321147 12/1998

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

(Continued)

*Primary Examiner*—Joseph L. Williams
*Assistant Examiner*—Elmito Breval
(74) *Attorney, Agent, or Firm*—Robert E. Bushnell, Esq.

(57) ABSTRACT

A plasma display panel design having a display area and a peripheral area surrounding the display area. Within the display area are discharge cells, and within the peripheral area are dummy cells that serve as a location where fluorescent paste is injected onto in an early stage of making the display, enabling the injection amount and injection speed from a nozzle to stabilize before the fluorescent material is deposited into the discharge cells. A surface area that the fluorescent material is deposited on in the peripheral area is increased to provide for a more rapid stabilization of the injection pressure and injection amount of the paste in the making of the display. A sufficient gap is present between a sealant and the dummy structure so that air and foreign matter can be expelled.

21 Claims, 7 Drawing Sheets

U.S. PATENT DOCUMENTS

| | | | | |
|---|---|---|---|---|
| 5,952,782 | A | 9/1999 | Nanto | |
| RE37,444 | E | 11/2001 | Kanazawa | |
| 6,439,943 | B1 * | 8/2002 | Aoki et al. | 445/24 |
| 6,630,916 | B1 | 10/2003 | Shinoda | |
| 6,674,238 | B2 * | 1/2004 | Otani et al. | 313/587 |
| 6,707,436 | B2 | 3/2004 | Setoguchi et al. | |
| 2003/0090443 | A1 * | 5/2003 | Kobayashi | 345/60 |

FOREIGN PATENT DOCUMENTS

| | | |
|---|---|---|
| JP | 2917279 | 4/1999 |
| JP | 2001-043804 | 2/2001 |
| JP | 2001-118513 | 4/2001 |
| JP | 2001-160360 | 6/2001 |
| JP | 2001-325888 | 11/2001 |
| JP | 2002-373593 | 12/2002 |
| JP | 2004-039422 | 2/2004 |
| JP | 2004-055495 | 2/2004 |
| WO | WO 02/084689 | 10/2002 |

OTHER PUBLICATIONS

*Office Action* from the Japanese Patent Office issued in Applicant's corresponding Japanese Patent Application No. 2005-181253 dated Sep. 2, 2008.

* cited by examiner

PLASMA DISPLAY PANEL

CLAIM OF PRIORITY

This application makes reference to, incorporates the same herein, and claims all benefits accruing under 35 U.S.C. § 119 from an application for PLASMA DISPLAY PANEL earlier filed in the Korean Intellectual Property Office on Aug. 30, 2004, and there duly assigned Serial No. 10-2004-0068473.

BACKGROUND OF THE INVENTION

1. Field of the Invention

The present invention relates to a plasma display panel, and more particularly, to a plasma display panel having an improved structure where sufficient air exhaustion can be achieved without sacrificing discharge efficiency.

2. Description of the Related Art

The plasma display panel is recently replacing the cathode ray tube (CRT) as a device for displaying images. In a plasma display panel, a discharge gas is filled between two substrates supporting a plurality of electrodes, a discharge voltage is applied to the electrodes in the panel to generate ultraviolet rays, and a phosphor layer of a predetermined pattern is excited by the ultraviolet rays to produce a visible image.

The plasma display panel can be classified into a direct current (DC) type and an alternating current (AC) type. In the DC type plasma display panel, electrodes are exposed in a discharge space so that electric charges move directly between corresponding electrodes. In the AC type plasma display panel, at least one side of the electrodes is covered with a dielectric layer, so that a discharge is achieved by movements of wall charges accumulated on the dielectric layer.

Since charges directly move between the corresponding electrodes in the DC type plasma display panel, the electrodes are severely damaged. In order to preserve the electrodes, the AC type plasma display panel having a three-electrode surface discharge type structure has been recently adopted.

In general, an AC type plasma display panel includes two substrates separated from each other and in parallel, and main barrier ribs defining a plurality of discharge cells forming an area producing the image. In addition, a phosphor layer is formed within the discharge cells defined by the main barrier ribs.

The phosphor layer can be formed in various ways, one being nozzle injection. Nozzle injection refers to a process where fluorescent material is ejected from a nozzle dispenser and is injected into the discharge cells. According to the nozzle injection method, fluorescent material in the form of a paste is injected into the discharge cells from a plurality of nozzles to form the phosphor layer to a predetermined thickness. One drawback of the nozzle injection method is that injection amount and injection pressure of the fluorescent material during the initial stage of the injection process is unstable and difficult to control, making it difficult to form a phosphor layer having a uniform thickness in each of the discharge cells. In order to overcome this problem, the fluorescent material can be injected into the discharge cells after the injection amount and injection pressure of the fluorescent material stabilizes so that a phosphor layer of uniform thickness can be formed in each discharge cell. In order to stabilize the injection amount and injection pressure of the fluorescent material at early stage of injection, a buffer period should be employed. When a buffer period is employed, dummy barrier ribs are formed on outer portions of the outermost main barrier ribs. The dummy barrier ribs define dummy cells at the outer portion of the outermost discharge cells discharge cells after the injection amount and injection pressure of the fluorescent material stabilizes so that a phosphor layer of uniform thickness can be formed in each discharge cell. In order to stabilize the injection amount and injection pressure of the fluorescent material at early stage of injection, a buffer period should be employed. When a buffer period is employed, dummy barrier ribs are formed on outer portions of the outermost main barrier ribs. The dummy barrier ribs define dummy cells at the outer portion of the outermost discharge cells.

The dummy cells defined by the dummy barrier ribs serve as buffers that serve to stabilize the injection amount and injection pressure of the fluorescent material. The fluorescent material can be injected first into the dummy cells at the initial stage of injection process when the injection amount and injection pressure are not stabilized.

Then, when the injection amount and injection pressure has stabilized, the fluorescent material is injected into the discharge cells which are located in the area where the image is displayed. By doing so, the thickness of the phosphor layer within the discharge cells can be better controlled so that a uniform thickness is achieved for every discharge cell. In this scenario, the dummy cells need to be sufficiently large so that stabilization of the injection amount and injection pressure occurs when the fluorescent material is injected into the discharge cells.

However, in order ensure that there is sufficient space for the dummy cells, the dummy barrier ribs are formed to extend adjacent to a sealing member that seals the two substrates. When this is done, spaces between the dummy barrier ribs and the sealing member tend to become too small so that air exhaustion through a space between the dummy barrier ribs and the sealing member cannot be satisfactorily achieved. As a result, impurities remain in the panel, causing the discharge voltage to rise, resulting in mis-discharging, which leads to a decrease in the discharge efficiency. Therefore, what is needed is a design for a plasma display panel where there is sufficient space for the dummy barrier ribs so that the fluorescent material in each of the discharge cells can be formed to the same thickness, the design also being able to allow for satisfactory air exhaustion so that the problems of mis-discharging and decrease in discharge efficiency can be avoided.

SUMMARY OF THE INVENTION

It is therefore an object of the present invention to provide an improved design for a plasma display panel.

It is also an object of the present invention to provide a design for a plasma display panel where there is sufficient space for the dummy cells and where there is also sufficient air exhaustion so that the problems of mis-discharging and a drop in discharge efficiency can be avoided.

It is still an object of the present invention to provide a design for a plasma display panel that leads to uniform thicknesses of fluorescent material between the discharge cells while having substantial air exhaustion capabilities.

It is further an object of the present invention to provide a design for a plasma display panel that can more quickly stabilize injection pressure and injection amount of a fluorescent paste during the making of the display.

These and other objects can be achieved by a plasma display panel that has dummy barrier ribs with an improved structure that is sufficiently spaced from the sealing member, where the dummy barrier ribs are designed to stabilize injection amount and injection pressure of a fluorescent material completely and rapidly while allowing for sufficient air exhaustion so that discharge efficiency is not sacrificed.

According to an aspect of the present invention, there is provided a plasma display panel that includes an upper substrate, an upper dielectric layer arranged under the upper substrate, a plurality of sustain electrode pairs embedded within the upper dielectric layer, a lower substrate facing the upper substrate, a lower dielectric layer arranged over the lower substrate, a plurality of address electrodes embedded within the lower dielectric layer and crossing the plurality of sustain electrode pairs, a plurality of main barrier ribs arranged on an upper surface of the lower dielectric layer and defining a plurality of discharge cells on which the sustain electrode pairs and the address electrodes are commonly arranged to correspond to each other, a plurality of dummy barrier ribs arranged on outer portions of an outermost of the main barrier ribs, the dummy barrier ribs defining a plurality of dummy cells, an outermost portion of the dummy barrier ribs having a height higher than a height of the main barrier ribs, and a phosphor layer arranged within the discharge cells and arranged within at least some of the plurality of dummy cells.

The plurality of main barrier ribs include a plurality of first main barrier ribs extending on both sides of the address electrodes and in parallel to the address electrodes, and a plurality of second main barrier ribs arranged at both end portions of the plurality of first main barrier ribs and extending in a direction that crosses the plurality of first main barrier ribs. The plurality of dummy barrier ribs include a plurality of first dummy barrier ribs extending from at least one end portion of the plurality of first main barrier ribs, and a plurality of second dummy barrier ribs arranged at end portions of the first dummy barrier ribs and extending in a direction of crossing the first dummy barrier ribs, the plurality of first dummy barrier ribs having a same height as the first main barrier ribs.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
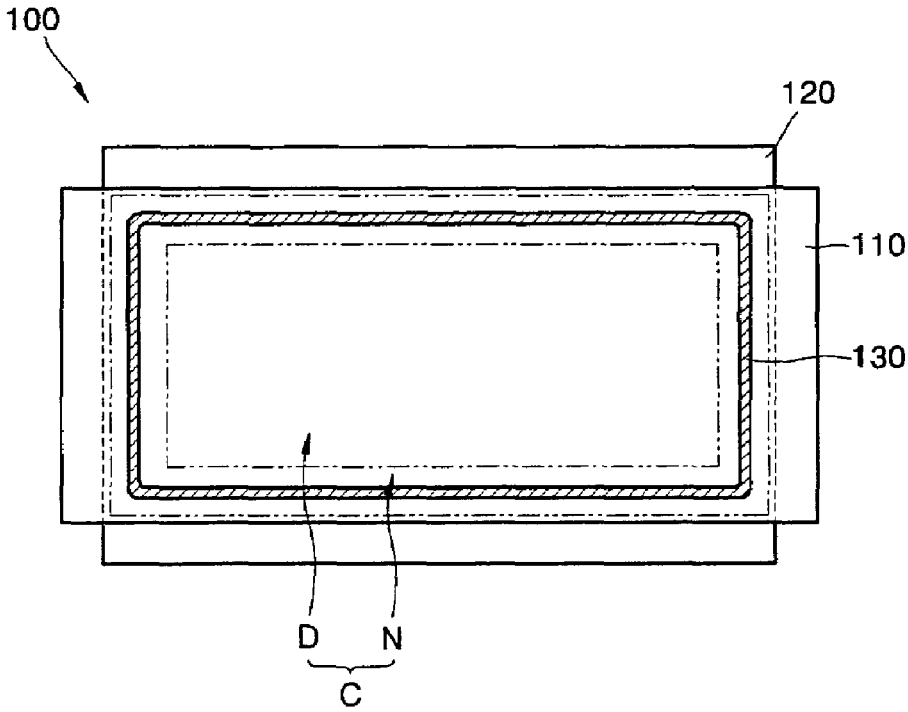
FIG. 1 is a plan view of a plasma display panel according to an embodiment of the present invention.

Turning now to the figures, FIG. 1 is a plan view of a plasma display panel 100 according to an embodiment of the present invention. The plasma display panel 100 of FIG. 1 includes an upper panel 110 and a lower panel 120 coupled to the upper panel 110 and parallel with the upper panel 110. A common area (C) where the upper panel 110 and the lower panel 120 overlap each other can be divided into a display area (D) and a dummy area (N). Here, the display area (D) is located at a center of the common area (C) and is where images are produced and displayed while the dummy area (N) is located along edges or periphery of the common area (C) and is not located where images are displayed. In the dummy area (N), a sealing member 130, such as frit, is located along the edges to couple and seal the upper and lower panels 110 and 120 together.

Figure 2:
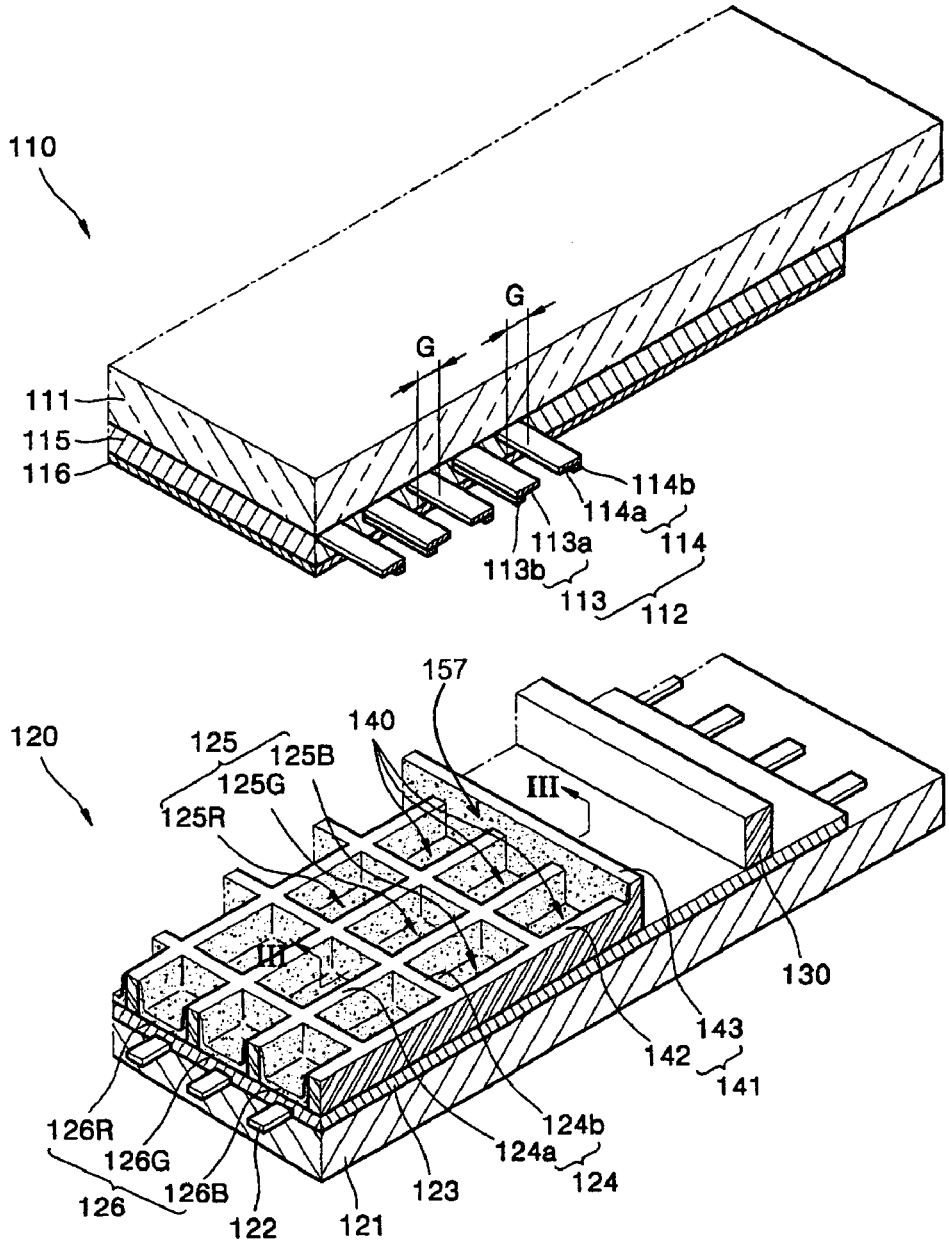
FIG. 2 is a partial perspective view of the plasma display panel of FIG. 1.
Figure 3:
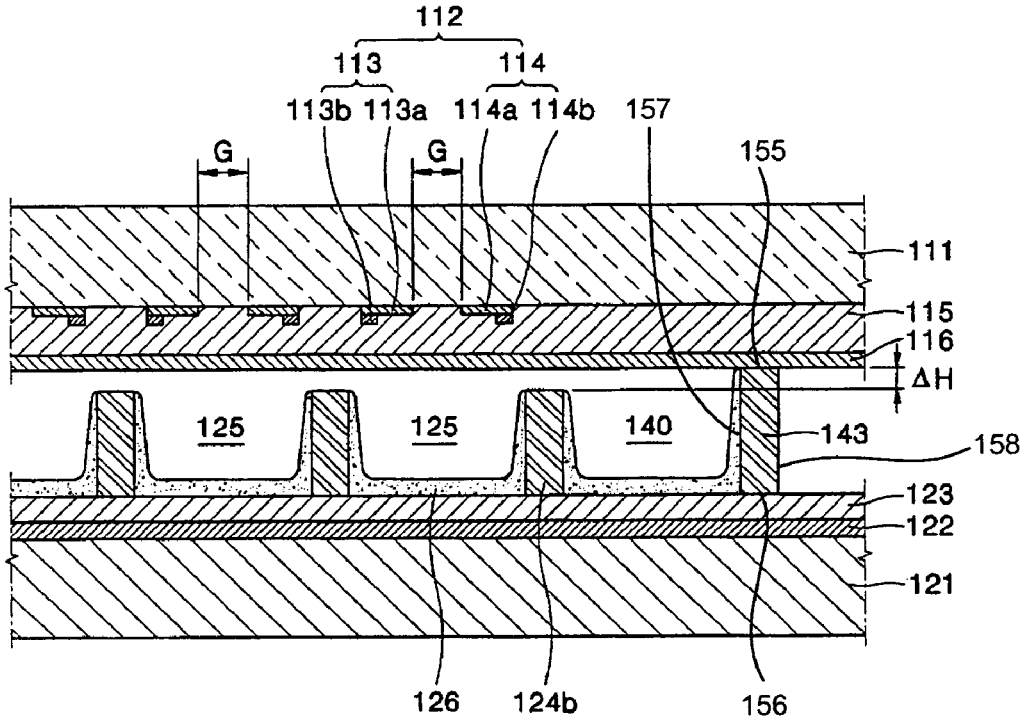
FIG. 3 is a cross-sectional view of the plasma display panel along line III-III of FIG. 2.

Turning now to FIGS. 2 and 3, FIG. 2 is a partial perspective view of the display area (D) and the dummy area (N) of the plasma display panel 100 of FIG. 1, and FIG. 3 is a cross-sectional view of the plasma display panel 100 along line III-III of FIG. 2. Referring to FIGS. 2 and 3, upper panel 110 includes an upper substrate 111 that is made out of a transparent glass material, through which the visible image can pass through, while lower panel 120 includes a lower substrate 121 that faces the upper substrate 111.

A plurality of pairs of sustain electrodes 112 that extend along discharge cells 125 are arranged in a predetermined direction and are located under the upper substrate 111. A plurality of address electrodes 122, extending to cross the sustain electrode pairs 112, are located over the lower substrate 121. The address electrodes 122 are arranged to have a stripe pattern on the lower substrate 121, and at least one address electrode 122 is found at each discharge cell 125. The address electrodes 122 are covered and embedded by a lower dielectric layer 123 formed on the lower substrate 121.

The sustain electrode pairs 112 are located on a lower surface of the upper substrate 111, and each pair includes a common electrode 113 and a scan electrode 114 with a discharge gap (G) therebetween. The scan electrode 114 generates an address discharge with the address electrode 122, and the common electrode 113 generates a sustain discharge with the scan electrode 114. The common electrode 113 includes a common transparent electrode 113*a* and a common bus electrode 113*b* connected to the common transparent electrode 113*a*. The scan electrode 114 includes a scan transparent electrode 114*a* and a scan bus electrode 114*b* connected to the scan transparent electrode 114*a*.

The common and scan transparent electrodes 113*a* and 114*a* are formed of a transparent material such as indium tin oxide (ITO) so that visible light produced during the sustain discharge can pass through them. The common and scan bus electrodes 113*b* and 114*b* connected to the common and scan transparent electrodes 113*a* and 114*a* serve to apply voltages to the common and scan transparent electrodes 113*a* and 114*a*. It is desirable that the common and scan bus electrodes 113*b* and 114*b* are made of a metal having a high conductivity, such as Cu or Ag, in order to improve electric conductance and reduce a voltage drop along the relatively less conductive ITO common and scan transparent electrodes 113*a* and 114*a*.In addition, the common and scan bus lectrodes 113*b* and 114*b* are designed to have narrower widths than the common and scan transparent electrodes 113*a* and 114*a*, and extend perpendicular to the address electrodes 122

The sustain electrode pairs 112 are covered and embedded by an upper dielectric layer 115 formed on the lower surface of the upper substrate 111. The upper dielectric layer 115 can in turn be covered by a protective layer 116 made out of MgO. The protective layer 116 serves to prevent charged particles from directly colliding with the upper dielectric layer 115 and causing damage to the upper dielectric layer 115. The protective layer 116 also serves to emit secondary electrons when charged particles collide with the protective layer 116, allowing an improved discharge efficiency.

Main barrier ribs 124 are located between the upper and lower substrates 111 and 121. More specifically, main barrier ribs 124 are located between the protective layer 116 and the lower dielectric layer 123 and are designed to have a predetermined pattern. The main barrier ribs 124 define a plurality of discharge cells 125, and serve to prevent cross talk from occurring between neighboring discharge cells 125. A discharge gas is filled within the discharge cells 125 defined by the main barrier ribs 124, and a Penning mixed gas can be used as the discharge gas.

According to FIG. 2, the main barrier ribs 124 defining the discharge cells 125 include first main barrier ribs 124*a* spaced apart at predetermined distances from each other, and second main barrier ribs 124*b* extending perpendicularly from sides of the first main barrier ribs 124*a* and having substantially the same heights as the first main barrier ribs 124*a*. The first main barrier ribs 124*a* are located between ones of the address electrodes 122 and run parallel to the address electrodes 122, and the second main barrier ribs 124*b* are located between ones of the sustain electrode pairs 112 and run parallel to the sustain electrode pairs 112. In addition, the second main barrier ribs 124*b* are located at both end portions of the first main barrier ribs 124*a* to close both ends of the first main barrier ribs 124*a* together.

Since the first main barrier ribs 124*a* and the second main barrier ribs 124*b* are formed as above, the discharge cells 125 can be defined as matrix pattern with four closed sides respectively. However, the second main barrier ribs 124*b* can be omitted and the discharge cells can instead be defined as a stripe pattern. Thus the shape of the discharge cells are not limited to the above matrix shape.

A phosphor layer 126 is located within the discharge cells 125 defined by the main barrier ribs 124 and includes a fluorescent material. The fluorescent material is applied on side surfaces of the main barrier ribs 124 and on an upper surface of the lower dielectric layer 123 to form the phosphor layer 126. The fluorescent material can be classified into red, green, and blue fluorescent materials that are excited to produce red, green, and blue visible light. The phosphor layer 126 can be also classified into red, green, and blue phosphor layers 126R, 126G, and 126B. In addition, the discharge cells where the red, green, and blue phosphor layers 126R, 126G, and 126B are located within become red, green, and blue discharge cells 125R, 125G, and 125B, and three neighboring red, green, and blue discharge cells 125R, 125G, and 125B form a unit pixel.

The phosphor layer 126 can be formed in various ways, such as by a nozzle injection method. In the nozzle injection method, red, green, and blue fluorescent materials in the form of a paste are injected into the discharge cells 125 through a plurality of nozzles to form the phosphor layers 126R, 126G, and 126B of a predetermined thickness. According to the nozzle injection method, the fluorescent material paste is injected into the discharge cells 125 that are arranged along the extending direction of the address electrodes 122 by at least one nozzle, thus forming the phosphor layer 126 in the discharge cells 125. However, according to the nozzle injection method, injection amount and injection pressure of the fluorescent material at an early stage of injection are not stable. Accordingly, the thickness of the phosphor layer formed at the initial stage and the thickness of the phosphor layer that is formed after stabilizing the injection amount and injection pressure of the fluorescent material are different from each other. In order to obtain uniform image quality throughout the entire display area (D), the thickness of the phosphor layer needs to be substantially the same in each of the discharge cells 125.

In order to achieve this uniformity, dummy barrier ribs 141 are formed on outer portions of outermost the main barrier ribs 124 at the periphery dummy area (N) of the panel. The dummy barrier ribs 141 serve as buffers that stabilize the injection amount and injection pressure of the fluorescent material that is injected at the initial buffer period of injection.

The outermost portions of the dummy barrier ribs 141 are separated by a predetermined distance from the sealing member 130 so that sufficient air exhaustion can occur. Dummy barrier ribs 141 define dummy cells 140 of a closed type at outer portions of the outermost discharge cells so that the injection amount and injection pressure of the fluorescent material can stabilize sufficiently and rapidly. When the dummy cells 140 are closed structures, surface area where the fluorescent material can be applied to at the initial stage of injection can be increased.

In order to achieve the closed dummy cell structure, the dummy cells 140 are defined by dummy barrier ribs 141 having the design illustrated in FIGS. 2 through 7. The dummy barrier ribs 141 include first dummy barrier ribs 142 extending from the end portions of the first main barrier ribs 124*a* and having substantially the same height as that of the first main barrier ribs 124*a*. The dummy barrier ribs 141 also include second dummy barrier ribs 143 located at end portions of the first dummy barrier ribs 142 and extending in a direction that crosses the first dummy barrier ribs 142.

In the design of FIG. 2, the second dummy barrier ribs 143 can be separated by a predetermined distance, such as 10 mm or more, from the sealing member 130 to allow for air exhaustion. As a result, impurities which can cause an increase of discharge voltage and mis-discharging over time do not remain on the space between the dummy barrier ribs 141 and the sealing member 130, preventing discharge efficiency from being reduced over the life of the display.

Another design consideration is that the height of the second dummy barrier rib 143 is made to be higher than the height of the main barrier ribs 124. By doing so, the area where the fluorescent material is applied to on the second dummy barrier ribs 143 can be increased. This is because increasing the height of the second dummy barrier ribs 143 increases the amount of surface area to which the fluorescent material can be applied, so that more fluorescent material can be applied onto the increased inner surface of the second dummy barrier ribs 143.

A difference in heights (ΔH) between the second dummy barrier ribs 143 and the main barrier ribs 124 or between the second dummy barrier ribs 143 and the first dummy barrier ribs 142, is preferably within the range of 6~20 μm and is supported by the empirical data illustrated in Table 1 below:

TABLE 1

| | | ΔH (μm) | | | | | | | | | | | |
|---|---|---|---|---|---|---|---|---|---|---|---|---|---|
| | | 0 | 2 | 4 | 6 | 8 | 10 | 12 | 14 | 16 | 18 | 20 | 22 |
| The number of defective discharge cells | Red | 9 | 9 | 2 | 0 | 0 | 0 | 0 | 0 | 0 | 0 | 0 | 0 |
| | Green | 9 | 9 | 2 | 0 | 0 | 0 | 0 | 0 | 0 | 0 | 0 | 0 |
| | Blue | 9 | 9 | 4 | 0 | 0 | 0 | 0 | 0 | 0 | 0 | 0 | 0 |

Referring to Table 1, when the difference in heights ΔH between second dummy barrier rib 143 and the first dummy barrier rib 142 is less than 6 μm, defective discharge cells having the phosphor layer of uneven thicknesses were generated. Therefore, ΔH should be designed to be 6 μm or greater. If ΔH is larger than 20 μm, noise is increased. Therefore, ΔH, the height difference between the second dummy barrier ribs 143 and the first dummy barrier ribs 142 is preferably between 6~20 μm.

Figure 4:
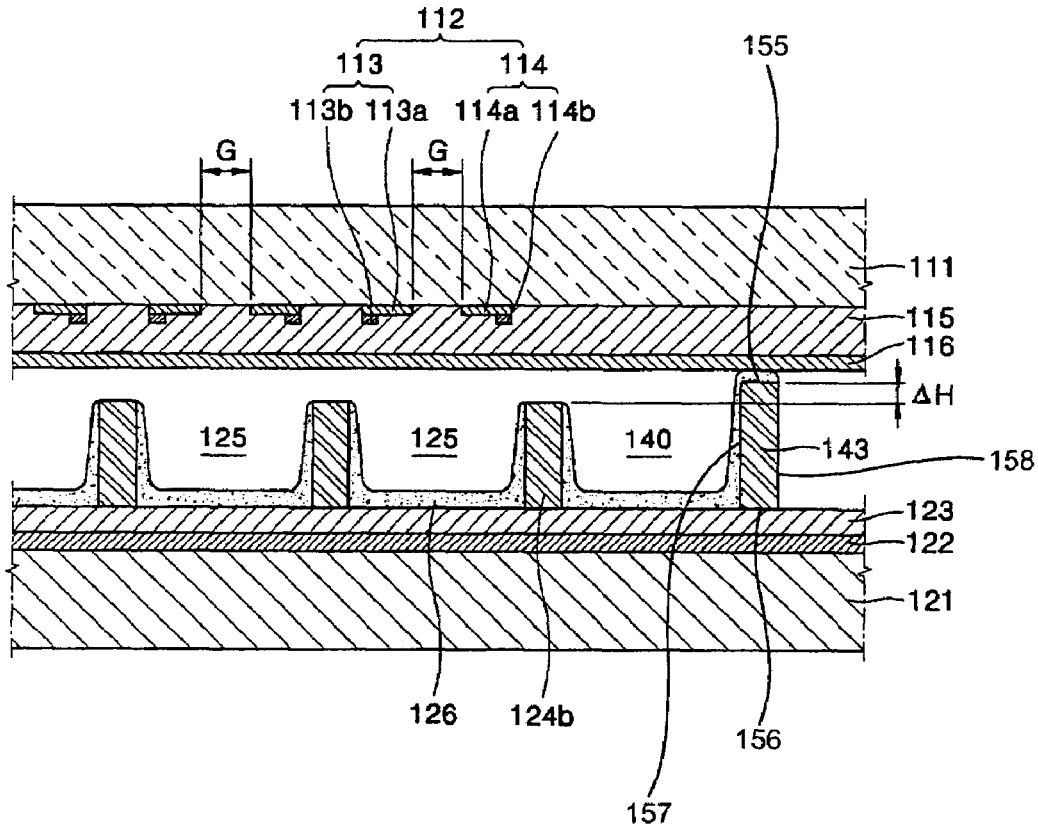
FIG. 4 is a cross-sectional view of a phosphor layer formed on dummy barrier ribs shown in FIG. 3.

In addition, an upper surface 155 of the second dummy barrier rib 143 can also be used as a location where fluorescent material is deposited during the buffer period to ensure even a larger area where the phosphor layer 126 can be applied. As illustrated in FIG. 4, the fluorescent material can be applied onto the upper surface 155 of the second dummy barrier ribs 143, as well as the inner surface 157 of the second dummy barrier ribs 143.

Figure 5:
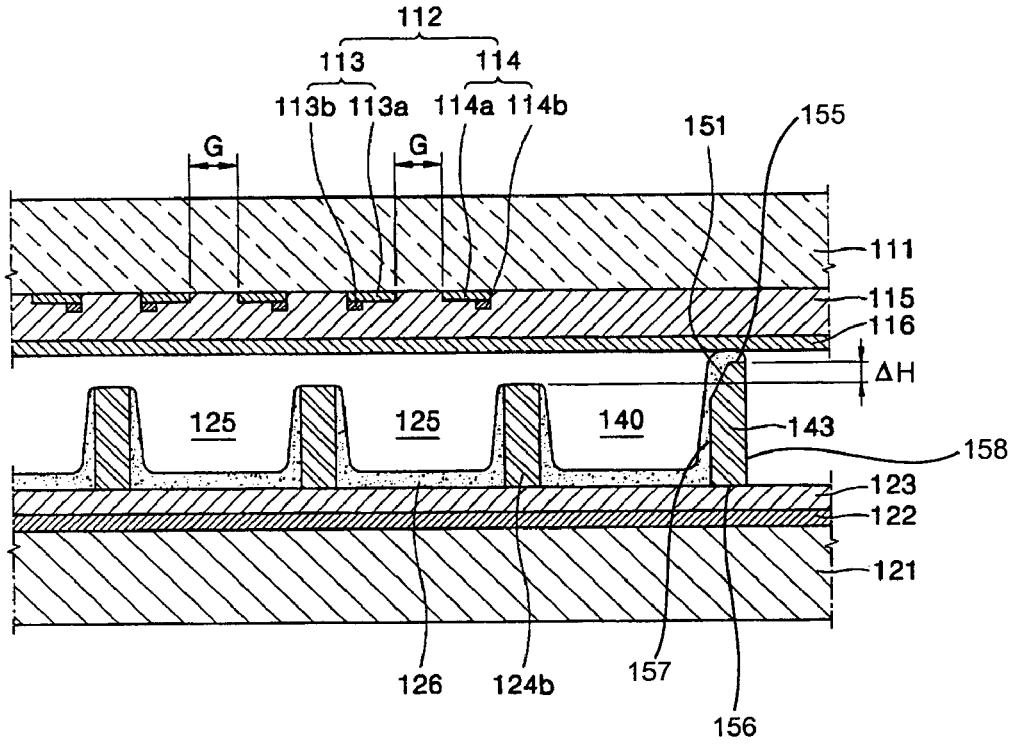
FIG. 5 is a cross-sectional view of a modified example of the dummy barrier ribs of FIG. 3.

Referring now to FIG. 5, in order to further increase the area where the fluorescent material can be applied, the upper surface 155 of the second dummy barrier ribs 143 can be designed to be smaller than the lower surface 156 of the second dummy barrier ribs 143. That is, a slant surface 151 is formed between the upper surface 155 and the inner surface 157 of the second dummy barrier ribs 143. By designing the second dummy barrier ribs 143 as in FIG. 5, the fluorescent material can be applied on the slant surface 151 so that the area where the fluorescent material is applied can be increased, and accordingly the fluorescent material applied to the slant surface 151 can flow into a dummy cell 140.

Figure 6:
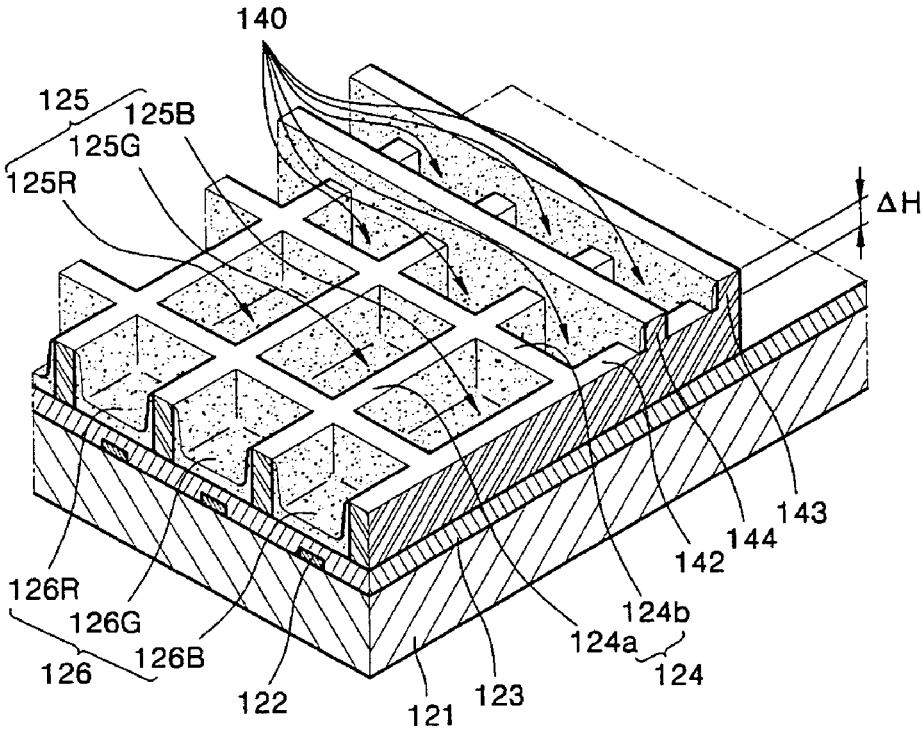
FIG. 6 is a partial perspective view of another modified example of the dummy barrier ribs of FIG. 3.

Turning now to FIG. 6, FIG. 6 illustrates yet another design consideration of the present invention. Referring to FIG. 6, at least one or more additional second dummy barrier ribs 144 (hereinafter third dummy barrier ribs 144) can be formed between an outermost second main barrier rib 124*b* and the second dummy barrier rib 143. The third dummy barrier ribs 144 are additionally formed between an outermost second main barrier rib 124*b* and second dummy barrier rib 143 can have the same height as that of the second dummy barrier rib 143. As with the design concepts discussed in conjunction with FIG. 4, the fluorescent material can be applied on an upper surface of the third dummy barrier rib 144, as well as on an inner surface. Further, as with FIG. 4, a slant surface can also be formed on the third dummy barrier rib 144. Also, a top surface of the third dummy barrier ribs 144 can be made to be smaller than the lower surface thereof.

When the dummy barrier ribs 141 are designed to have one or more of the features discussed above, the injection amount and injection pressure can be stabilized more rapidly by injecting fluorescent material into the dummy cells 140, so that when the fluorescent material is later injected into the discharge cells 125 located in display area (D), the injection amount and injection pressure will have already been stabilized, leading to a uniform thickness of fluorescent material in each of the discharge cells 125 throughout display area (D).

Figure 7:
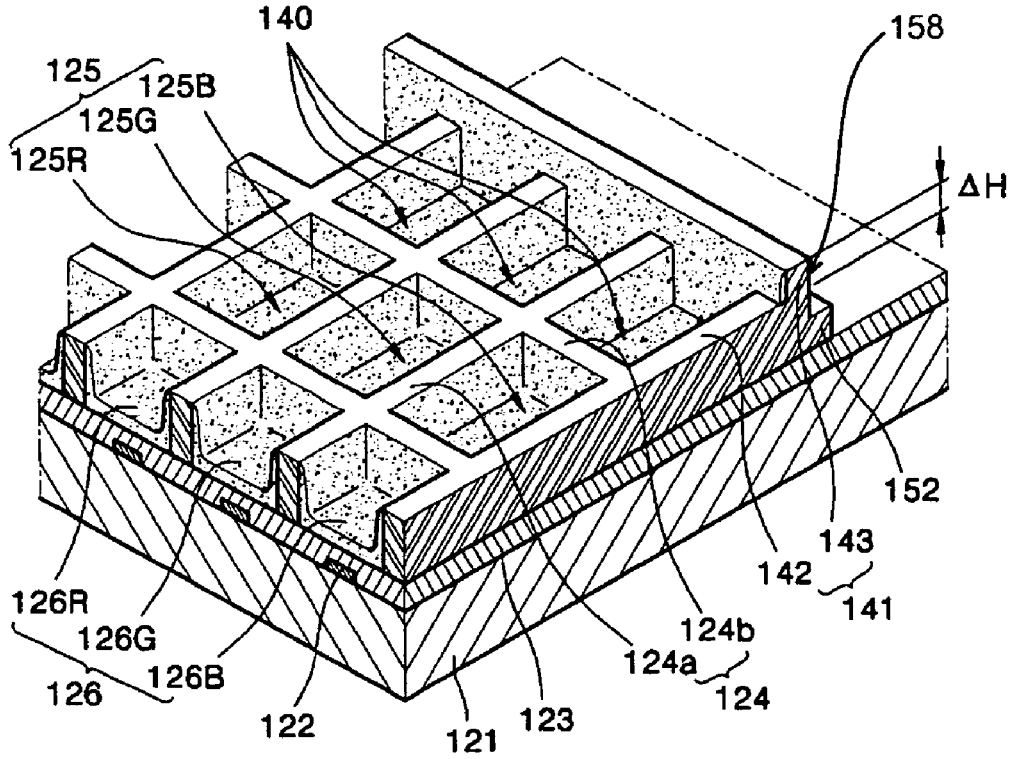
FIG. 7 is a partial perspective view of still another modified example of the dummy barrier ribs of FIG. 3.

Turning now to FIG. 7, FIG. 7 illustrates yet another design feature of the present invention. Referring now to FIG. 7, a lowermost portion of outer surface 158 of second dummy barrier ribs 143 can be designed to include a protrusion 152. The protrusion 152 protrudes from the outer surface 158 of the second dummy barrier ribs 143 on the upper surface of the lower dielectric layer 123. The protrusion 152 serves to enhance the strength of the second dummy barrier rib 143 and to prevent the second dummy barrier ribs 143 from being damaged.

According to the present invention. dummy barrier ribs are located in a non-image producing dummy area N external to a periphery of the contiguous image producing display area D so that a disnensing nozzle may initially deposit fluorescent material thereon allowing the nozzle ejection nressure and nozzle ejection rate to stabilize prior to the deposition of fluorescent material within the image producing display area D. Also according to the present invention, a space between the dummy barrier ribs and the sealing member can be designed accordingly so there is sufficient air exhaustion capabilities so that the discharge efficiency will not deteriorate. All of this is achieved while the thicknesses of the phosphor layers in each of the discharge cells is uniform.

What is claimed is:

1. A plasma display panel, comprising:

an upper substrate;

an upper dielectric layer arranged under the upper substrate;

plurality of sustain electrode pairs embedded within the upper dielectric layer;

a lower substrate facing the upper substrate;

a lower dielectric layer arranged over the lower substrate;

a plurality of address electrodes embedded within the lower dielectric layer and crossing the plurality of sustain electrode pairs, the plurality of address electrodes crossing the plurality of sustain electrode pairs within an image producing display area;

a plurality of main barrier ribs arranged on an upper surface of the lower dielectric layer and defining a plurality of discharge cells, the plurality of main barrier ribs being arranged within the image producing display area;

a plurality of dummy barrier ribs arranged within a non-image producing dummy area external to a periphery of the image producing display area, the dummy barrier ribs defining a plurality of dummy cells, an outermost portion of the dummy barrier ribs having a height higher than a height of the main barrier ribs; and a phosphor layer arranged within the discharge cells and arranged within at least some of the plurality of dummy cells.

2. The plasma display panel of claim 1, wherein the outermost portion of the dummy barrier ribs has an upper surface that is smaller than a lower surface thereof.

3. The plasma display panel of claim 1, wherein the plurality of dummy barrier ribs further include protrusions protruding from an outermost surface thereof on the upper surface of the lower dielectric layer.

4. The plasma display panel of claim 1, wherein a difference between the heights of the dummy barrier ribs and the main barrier ribs is within the range of 6~20 μm.

5. The plasma display panel of claim 1, wherein the phosphor layer is further arranged on at least a part of an upper surface of the dummy barrier ribs.

6. The plasma display panel of claim 1, wherein the outermost portion of the dummy barrier ribs are separated from a sealing member, the sealing member being adapted to couple together the upper substrate to the lower substrate.

7. The plasma display panel of claim 1, wherein the plurality of main barrier ribs include a plurality of first main barrier ribs extending on both sides of the address electrodes and in parallel to the address electrodes, and a plurality of second main barrier ribs arranged at both end portions of the plurality of first main barrier ribs and extending in a direction that crosses the plurality of first main barrier ribs, and the plurality of dummy barrier ribs include a plurality of first dummy barrier ribs extending from at least one end portion of the plurality of first main barrier ribs, and a plurality of second dummy barrier ribs arranged at end portions of the first dummy barrier ribs and extending in a direction that crosses the first dummy barrier ribs, the plurality of first dummy barrier ribs having a same height as the first main barrier ribs.

8. The plasma display panel of claim 7, wherein the plurality of second dummy barrier ribs include an upper surface that is smaller than a lower surface thereof.

9. The plasma display panel of claim 7, wherein the plurality of second dummy barrier ribs further include protrusions protruding from an outer surface thereof on the upper surface of the lower dielectric layer.

10. The plasma display panel of claim 7, wherein a difference between heights of the second dummy barrier ribs and heights of the first dummy barrier ribs is within the range of 6~20 μm.

11. The plasma display panel of claim 7, wherein the phosphor layer is further arranged on an upper surface of the second dummy barrier ribs.

12. The plasma display panel of claim 7, wherein the second dummy barrier ribs are separated from a sealing member, the sealing member being adapted to couple together the upper substrate to the lower substrate.

13. The plasma display panel of claim 7, the plurality of dummy barrier ribs further comprising at least one third dummy barrier rib arranged between the plurality of second main barrier ribs and the second dummy barrier rib, the at least one third dummy barrier rib having a same height as the second dummy barrier rib.

14. The plasma display panel of claim 13, wherein the at least one third dummy barrier rib having upper surface that is smaller than a lower surface thereof.

15. The plasma display panel of claim 13, wherein the phosphor layer is further arranged on upper surface of the at least one third dummy barrier rib.

16. The plasma display panel of claim 1, wherein the image producing display area is a contiguous area.

17. The plasma display panel of claim 5, wherein the phosphor layer is produced by a nozzle ejection process.

18. A plasma display panel, comprising:

an upper substrate;

an upper dielectric layer arranged on a lower portion of the upper substrate;

a plurality of sustain electrode pairs embedded within the upper dielectric layer;

a lower substrate facing the upper substrate;

a lower dielectric layer arranged on an upper portion of the lower substrate;

a plurality of address electrodes embedded within the lower dielectric layer and crossing the plurality of sustain electrode pairs, the plurality of address electrodes crossing the plurality of sustain electrode pairs within an image producing display area;

a plurality of main barrier ribs arranged on an upper surface of the lower dielectric layer and defining a plurality of discharge cells, the plurality of main barrier ribs being arranged within the image producing display area;

a plurality of dummy barrier ribs arranged within a non-image producing dummy area external to a periphery of the image producing display area, the plurality of dummy barrier ribs defining a plurality of dummy cells; and a phosphor layer arranged within at least some of the plurality of discharge cells and within at least a portion of the plurality of dummy cells.

19. The plasma display panel of claim 18, wherein the plurality of main barrier ribs include a first plurality of first main barrier ribs extending on both sides of ones of the plurality of address electrodes and in parallel to each other, and a plurality of second main barrier ribs extending from both ends of ones of the plurality of first main barrier ribs and crossing the plurality of first main barrier ribs, and the plurality of dummy barrier ribs include a plurality of first dummy barrier ribs extending from at least one end portion of the plurality of first main barrier ribs, and a plurality of second dummy barrier ribs extending from end portions of the plurality of first dummy barrier ribs and crossing the first dummy barrier ribs, the plurality of first dummy barrier ribs having a same height as the first main barrier ribs.

20. The plasma display panel of claim 19, wherein the phosphor layer comprises phosphor material, an amount of the phosphor material arranged on the plurality of second dummy barrier ribs is greater than an amount of phosphor material arranged on the plurality of first dummy barrier ribs.

21. The plasma display panel of claim 19, wherein the plurality of second dummy barrier ribs are higher than the plurality of second main barrier ribs.

* * * * *